US008333250B2

(12) United States Patent
Knepper et al.

(10) Patent No.: US 8,333,250 B2
(45) Date of Patent: Dec. 18, 2012

(54) MOUNTING CONSOLE WITH VISIBILITY IMPROVEMENTS

(75) Inventors: Anthony Jon Knepper, Asbury, IA (US); Joshua Dean Graeve, Peosta, IA (US); Jed Douglas Polzin, Platteville, WI (US); Michael Eugene Kennedy, Dubuque, IA (US); Darrel Jeffrey Rowan, Dubuque, IA (US)

(73) Assignee: Deere & Company, Moline, IL (US)

( * ) Notice: Subject to any disclaimer, the term of this patent is extended or adjusted under 35 U.S.C. 154(b) by 474 days.

(21) Appl. No.: 12/075,076

(22) Filed: Mar. 7, 2008

(65) Prior Publication Data

US 2009/0223684 A1 Sep. 10, 2009

(51) Int. Cl.
*E02F 3/00* (2006.01)

(52) U.S. Cl. ..... 172/781; 180/78

(58) Field of Classification Search ..... 172/780, 172/781; 180/324, 326, 333, 334, 78; 280/779
See application file for complete search history.

(56) References Cited

U.S. PATENT DOCUMENTS

| | | | | |
|---|---|---|---|---|
| 1,387,147 | A * | 8/1921 | Ford | 180/90 |
| 2,622,690 | A * | 12/1952 | Barenyi | 180/78 |
| 2,789,648 | A * | 4/1957 | Huffman | 187/224 |
| 3,737,003 | A * | 6/1973 | Beals et al. | 180/78 |
| 4,209,074 | A * | 6/1980 | York | 180/78 |
| 4,706,776 | A * | 11/1987 | Hyoki et al. | 180/334 |
| 4,733,745 | A * | 3/1988 | Lumpkins | 180/315 |
| 5,584,346 | A * | 12/1996 | Sakamoto et al. | 172/4.5 |
| 5,632,353 | A * | 5/1997 | Kimberley | 180/326 |
| 6,148,688 | A * | 11/2000 | Nishimaki | 74/493 |
| 6,382,359 | B1 * | 5/2002 | Lohmann | 187/231 |
| 7,243,982 | B2 * | 7/2007 | Kelley et al. | 296/190.08 |
| 7,314,116 | B2 * | 1/2008 | David et al. | 187/231 |

* cited by examiner

*Primary Examiner* — Thomas B Will
*Assistant Examiner* — Joel F. Mitchell
(74) *Attorney, Agent, or Firm* — Faegre Baker Daniels LLP

(57) ABSTRACT

A steering wheel assembly for a construction vehicle, such as a motor grader, is provided. The steering wheel assembly includes a chamfer or defines a space for viewing a portion of a grader blade of the motor grader.

29 Claims, 8 Drawing Sheets

MOUNTING CONSOLE WITH VISIBILITY IMPROVEMENTS

FIELD OF THE INVENTION

The present disclosure includes a console for controlling a construction vehicle, such as a motor grader.

BACKGROUND

Visibility to the grader blade of a motor grader is an important feature for the motor grader operator. The operator benefits by being able to see as much of the blade and ground around the blade as possible. Work and productivity increase when the operator is able to see obstructions such as grade stakes, manhole covers and other obstacles. In an operation such as steep slope work, the operator may lean to the side to keep the operator's body upright while the motor grader is at an angle due to the slope. The operator's visibility of the grader blade may be reduced by the steering console.

SUMMARY

According to one aspect of the present invention, a motor grader is provided that includes a chassis, a plurality of traction devices positioned to support the chassis and including at least one front traction device and at least one rear traction device, a grader blade supported by the chassis and positioned between the at least one front traction device and the at least one rear traction device, and an operator cab supported by the chassis. The operator cab includes a plurality of sides defining an interior region, the plurality of sides including a front side and at least two lateral sides. The front side includes at least one window. The motor grader further includes an operator seat assembly supported by the chassis and configured to support an operator, and a console assembly supported by the chassis between the operator seat assembly and the front side of the operator cab. The console assembly includes a console and a control supported on the console. The console includes a base supported by the chassis and a pedestal supported by the base. The pedestal includes a rear end, a forward end, and lateral sides including at least one substantially vertical chamfer extending rearward and inward to decrease the viewable profile of the console as seen by the operator in the operator seat assembly.

According to another aspect of the present invention, a motor grader is provided that includes a chassis including a mainframe defining a maximum lateral width, and a plurality of traction devices positioned to support the chassis and including at least one front traction device and at least one rear traction device. The mainframe extends between the at least one front traction device and the operator cab. The motor grader further includes a grader blade supported by the mainframe and positioned between the at least one front traction device and the at least one rear traction device, and an operator cab supported by the chassis. The operator cab includes a plurality of sides defining an interior region, the plurality of sides including a front side and at least two lateral sides. The front side includes at least one window. The motor grader further includes a steering wheel assembly supported by the chassis. The steering wheel assembly includes a steering console and a steering wheel rotatably supported on the steering console. The steering console includes a rear end, a console front end, and at least two lateral sides. A maximum lateral width between the at least two lateral sides of the console is less than the maximum lateral width of the mainframe.

According to another aspect of the present invention, a motor grader is provided that includes a chassis, a plurality of traction devices positioned to support the chassis and including at least one front traction device and at least one rear traction device, a grader blade supported by the chassis and positioned between the at least one front traction device and the at least one rear traction device, and an operator cab supported by the chassis. The operator cab includes a plurality of sides defining an interior region, the plurality of sides including a front side and at least two lateral sides. The front side includes at least one window. The motor grader further includes a steering wheel assembly supported by the chassis. The steering wheel assembly includes a steering console and a steering wheel rotatably supported on the steering console. The steering console includes a rear end, a front side, and at least two lateral sides. The rear end of the steering console defines a maximum lateral width less than a maximum width between the at least two lateral sides of the steering console.

According to another aspect of the present invention, a motor grader is provided that includes a chassis, a plurality of traction devices positioned to support the chassis and including at least one front traction device and at least one rear traction device, a grader blade supported by the chassis and positioned between the at least one front traction device and the at least one rear traction device, and a steering wheel assembly supported by the chassis. The steering wheel assembly includes a steering console and a steering wheel rotatably supported on the steering console. The steering console has a maximum lateral width. The steering wheel has a diameter. The diameter of the steering wheel is equal to or less than the maximum lateral width of the steering console.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
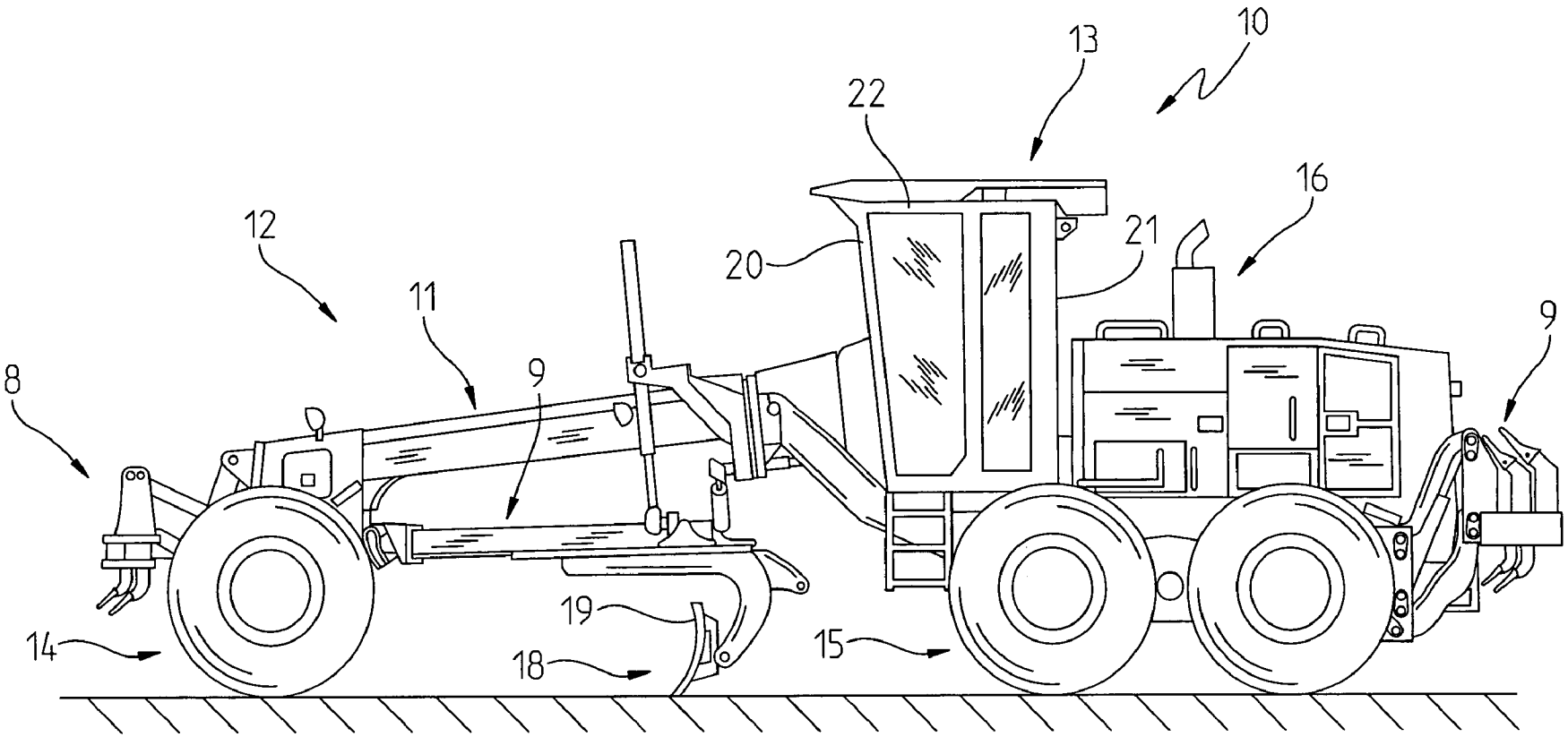
FIG. 1 is a side elevation view of a motor grader showing the motor grader including a chassis, an operator cab supported by the chassis, a grader blade extending below the chassis, and a plurality of wheels or traction devices supporting the chassis on the ground.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

Motor grader 10 is shown in FIG. 1 for spreading and leveling dirt, gravel, or other materials. Grader 10 includes articulated chassis 12, operator cab 13, front and rear traction devices 14, 15, also described as wheels, to propel chassis 12 and the remainder of grader 10 along the ground, engine 16 to power operation of grader 10, and grader blade 18 supported by chassis 12. Chassis 12 includes mainframe 11 extending between front wheels 14 and cab 13. Mainframe 11 supports grader blade 18.

Figure 7:
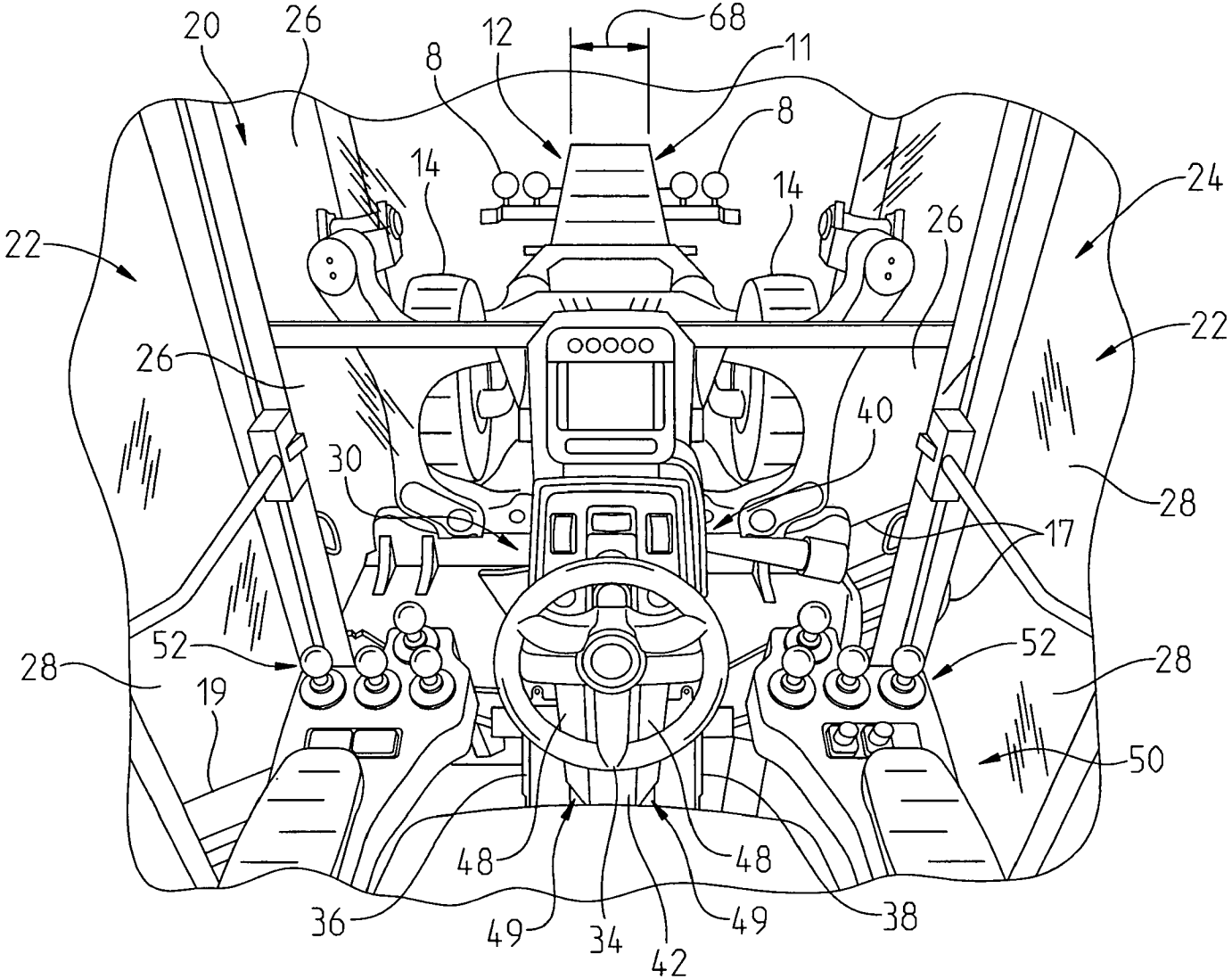
FIG. 7 is a view of the grader toe and heel from an operator's perspective.

Grader blade 18 of FIG. 1 is shown in an angled position in FIG. 7, such that the right end of grader blade 18 is a leading end 17, also described as toe 17, and the left end of grader blade 18 is a trailing end 19, also described as heel 19, for spreading and leveling. In addition to blade 18, grader 10 is provided with scarifier 8 and ripper 9 for working the soil, as shown in FIG. 1. Although motor grader 10 is described in detail, the features described herein may be provided on other vehicles such as bull dozers, front loaders, and other construction vehicles having various ground engaging tools and traction devices, such as wheels and tracks. Grader blade 18 is described as a ground engaging blade, but is not limited to engagement with soil, dirt, gravel, etc.

Figure 2:
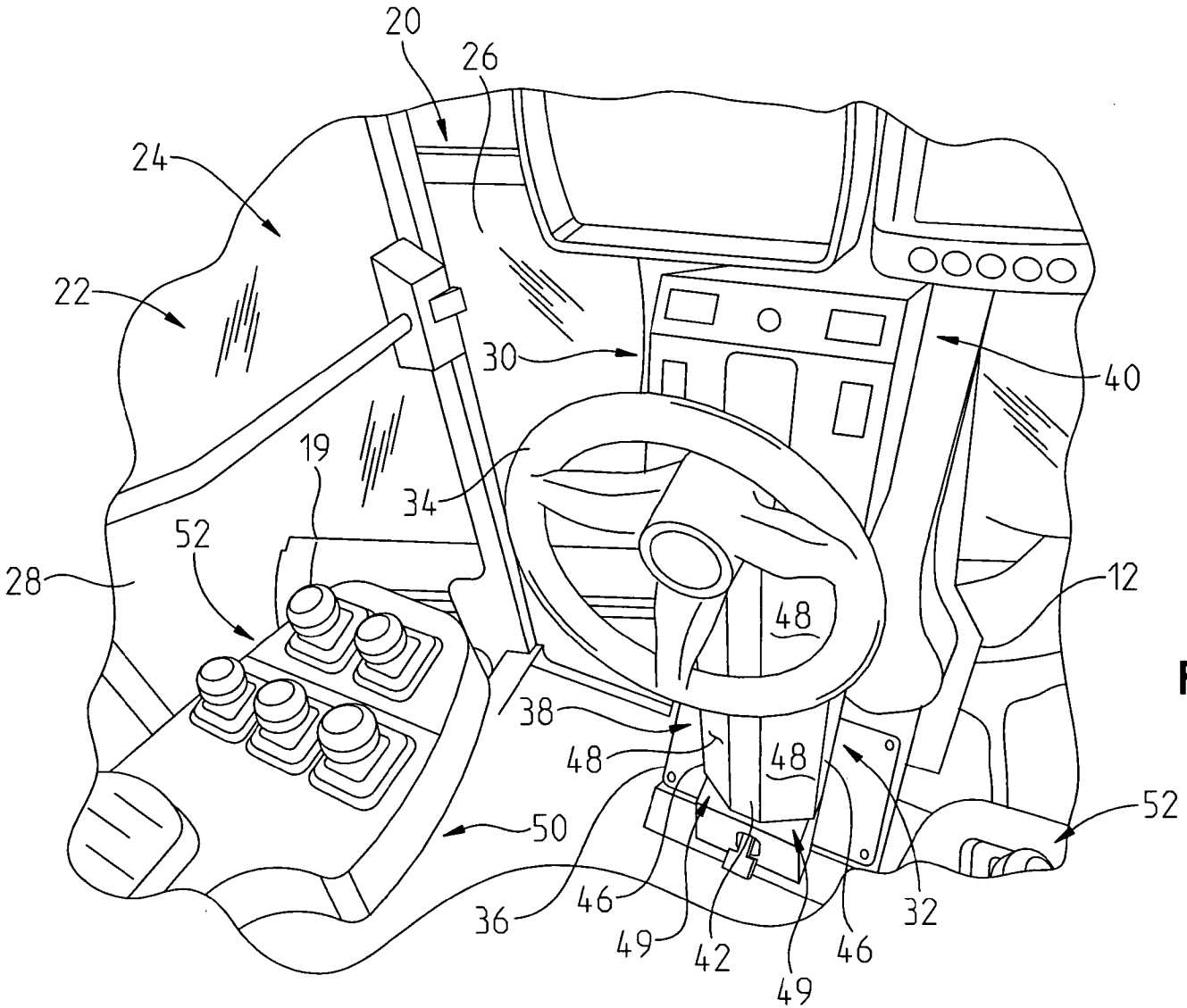
FIG. 2 is a view of a grader heel of the grader blade from an operator's perspective within the operator cab.
Figure 4:
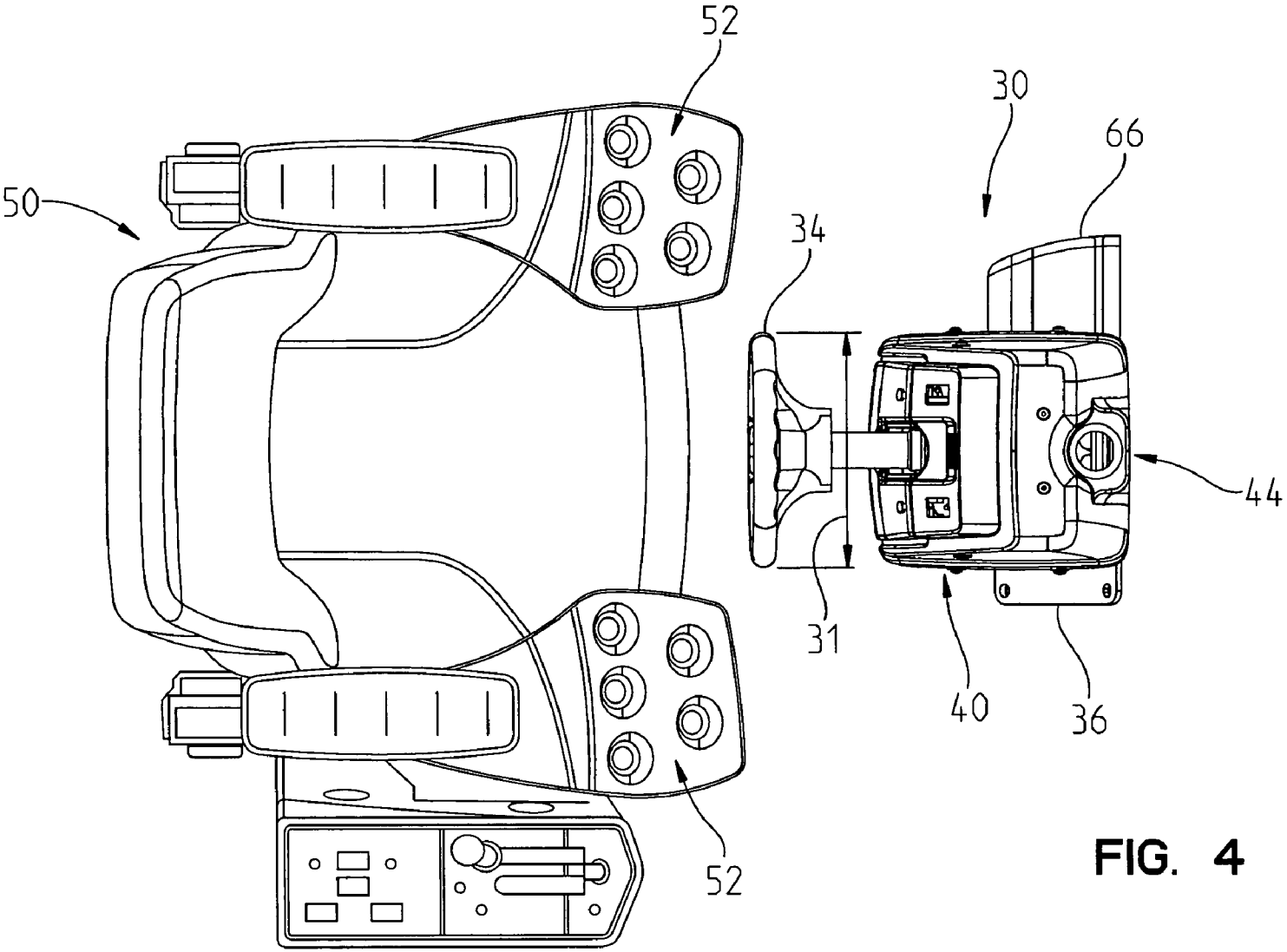
FIG. 4 is a top plan view of an operator seat assembly and a steering assembly including the steering console configured for use within the operator cab of the motor grader.

Operator cab 13 includes front side 20, rear side 21, and lateral side 22. As described in greater detail below, a plurality of sides including front side 20 and lateral side 22 define interior region 24 shown in FIG. 2. In FIG. 2, a view of toe 17 and heel 19 of grader blade 18 from an operator's perspective within interior region 24 is shown. Front side 20 includes at least one window 26. Similarly, lateral side 22 includes at least one window 28. Also located within interior region 24 is steering wheel or console assembly 30. Steering wheel assembly 30 is supported by chassis 12. Steering wheel assembly 30 includes steering console 32 and control 34 (shown in phantom) supported by steering console 32. Control 34 may control any function of motor grader 10 and may include steering wheel 34 defining a diameter 31 (FIG. 4). In this embodiment, diameter 31 is approximately 10.0 inches.

Interior region 24 of cab 13 also includes operator seat assembly 50. Referring to FIG. 4, steering wheel assembly 30 and operator seat assembly 50 are shown. Operator seat assembly 50 includes joysticks 52 configured to control at least one function of motor grader 10. In this view, steering wheel assembly 30 is shown with optional cover 66. Additional details of operator seat assembly 50 are provided in U.S. Provisional patent application Ser. No. unknown, entitled "ARMREST MOUNTED GRADER CONTROL," filed Mar. 7, 2008 to Martin L. Ruhter et. al, the entire disclosure of which is expressly incorporated by reference herein.

Figure 5:
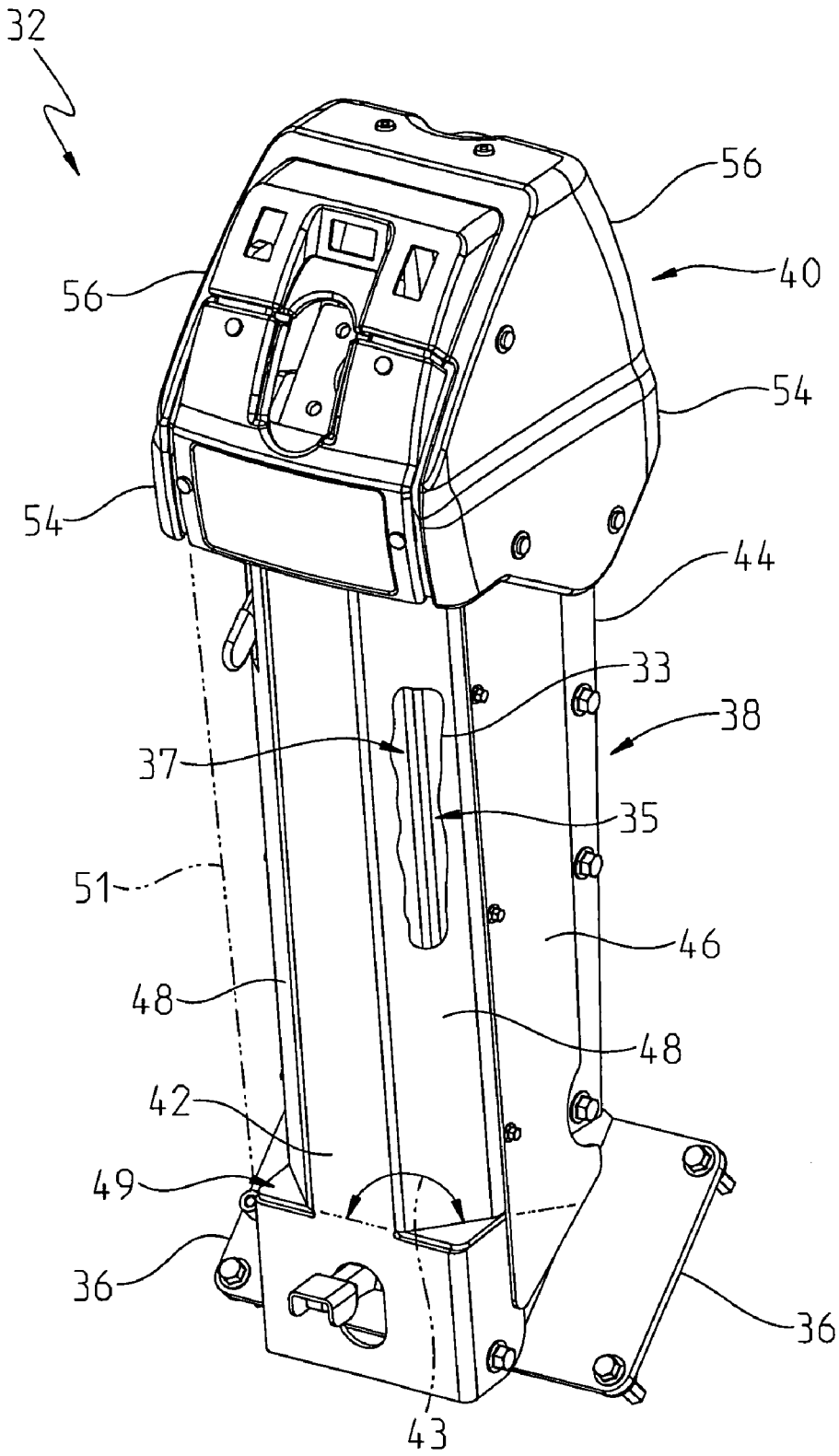
FIG. 5 is a perspective view of the steering console of FIG. 3.

Referring to FIG. 5, rear end 42, forward end 44, and lateral sides 46 of steering console 32 define interior region 35. A portion of pedestal 38 is broken away to show interior region 35 with controls 37, plumbing 37, and wire harnesses 37.

Figure 3:
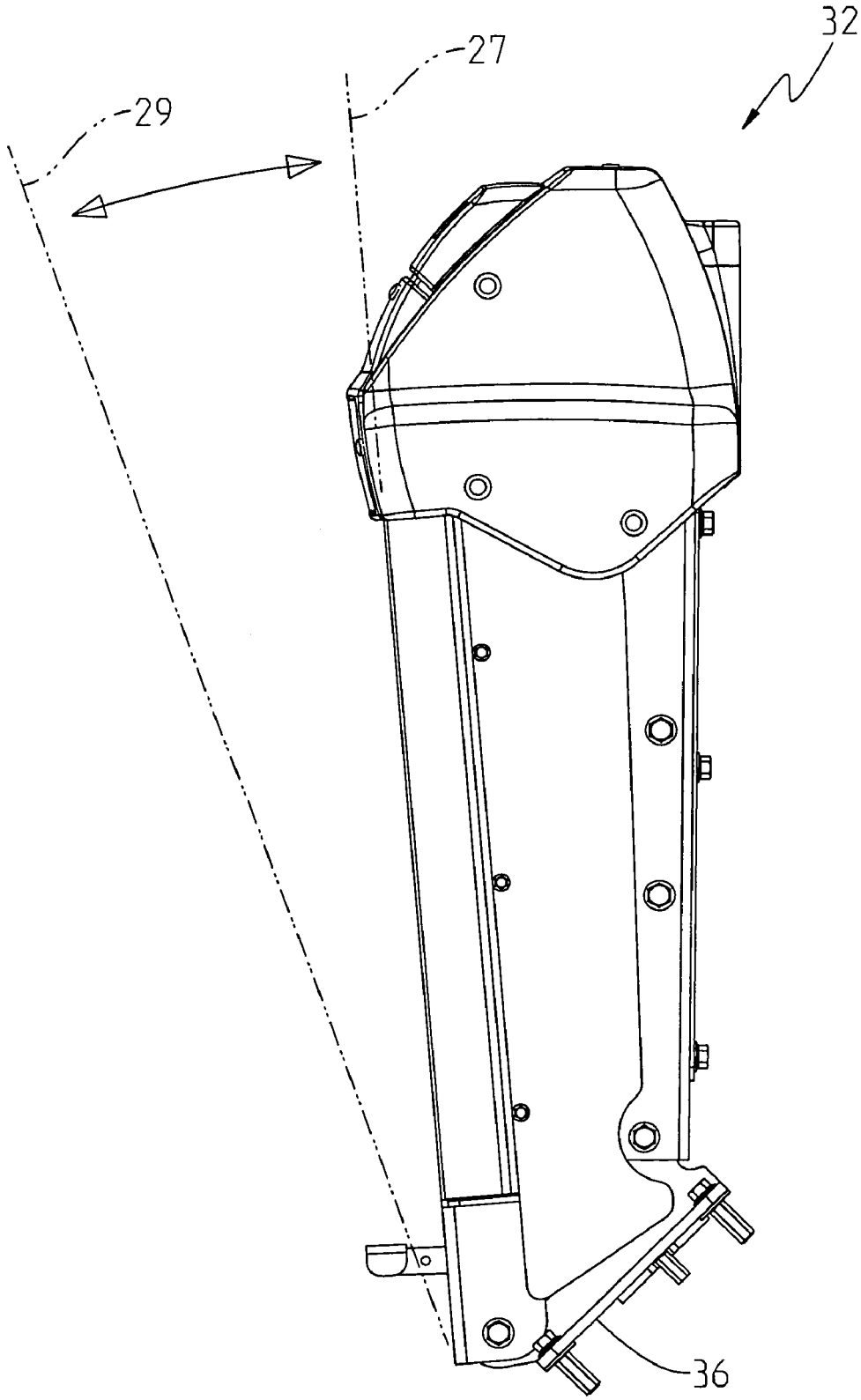
FIG. 3 is a side view of a steering console configured for use within the operator cab of the motor grader.

As shown in FIG. 2, steering console 32 is devoid of joysticks 52, such as those supported by seat assembly 50 and shown in FIG. 4. In another embodiment, steering console 32 may include joysticks 52. Steering console 32 includes base 36, supported by chassis 12, pedestal 38 supported by base 36, and head 40 supported by pedestal 38. Head 40 of steering console 32 includes lower portion 54 and upper portion 56. As shown in FIG. 3, console 32 may tilt to any position between first position 27, also known as a stowed position 27, and second position 29 relative to base 36.

Figure 8:
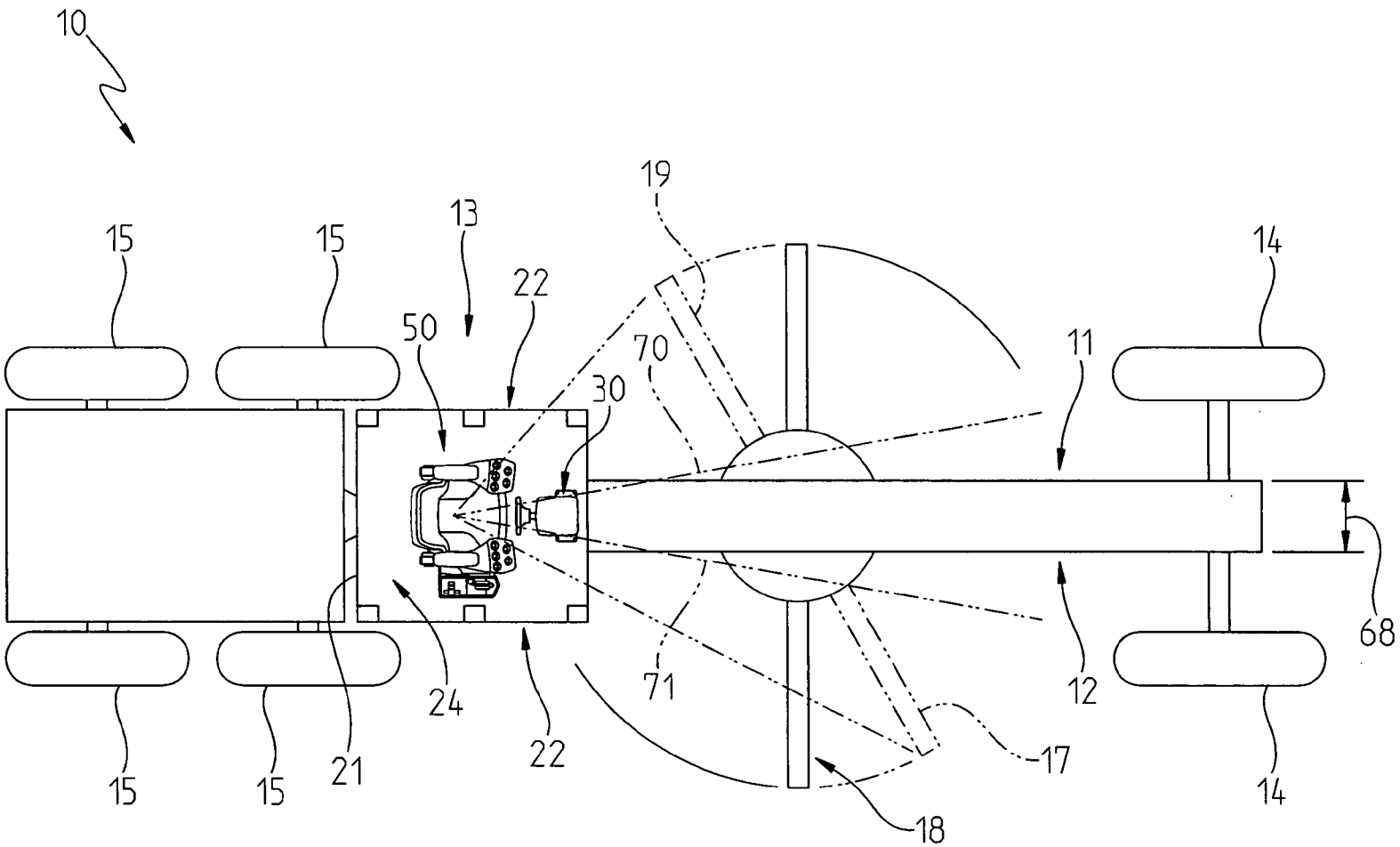
FIG. 8 is a top plan view of the motor grader including the operator seat assembly and the steering assembly of FIG. 4.

Referring back to FIG. 2, pedestal 38 includes rear end 42, forward end 44, and lateral sides 46. Although rear and front ends 42, 44 are shown as substantially flat, they may be other shapes or come to a point. Lateral sides 46 include chamfer 48. Chamfer 48 may be vertical or substantially vertical. Chamfer 48 may provide a flat or a curved surface and may extend rearward and inward. Chamfer 48 defines space 49 adjacent to chamfer 48. By providing space 49, obstructions to viewing toe 17 or heel 19 or grader blade 18 are decreased. Thus, space 49 provides an increased view of toe 17 or heel 19 of grader blade 18. Similarly, chamfer 48 decreases the viewable profile, as shown in FIG. 8, of pedestal 38 to increase the visibility of grader blade 18. For example in FIG. 8, the viewable profile 70 of pedestal 38 without chamfer 48 is greater than viewable profile 71 with chamfer 48. Vertical or substantially vertical line 51 (in phantom) shows viewable profile 70 of steering console 32 without left chamfer 48.

Chamfer 48 and rear end 42 define angle 43 (shown in phantom) greater than approximately 100 degrees. In the preferred embodiment, chamfer 48 and rear end 42 define angle 43 of approximately 135 degrees. In this embodiment angle 43 is shown towards interior region 35. In other embodiments, angle 43 is less than 100 degrees.

Figure 6:
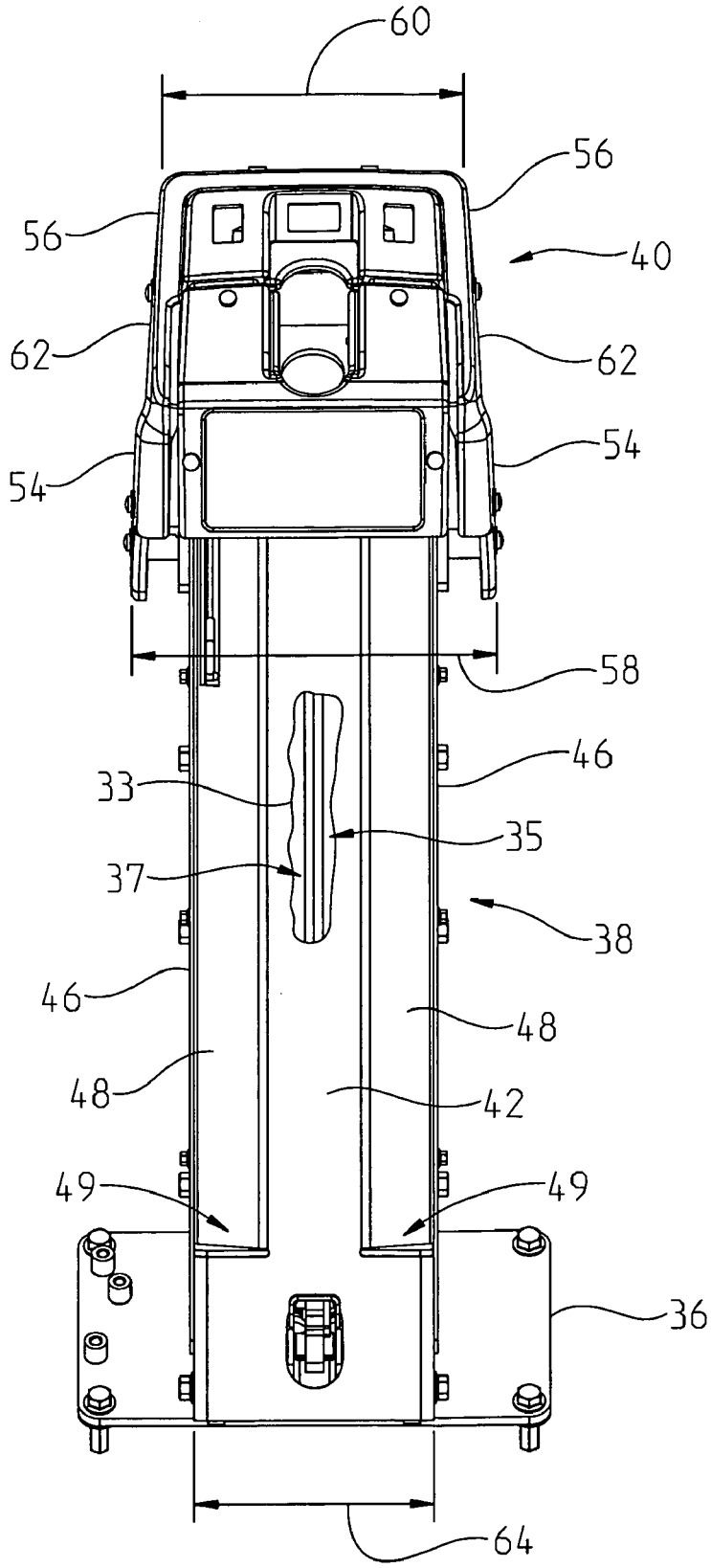
FIG. 6 is a forward view of the steering console of FIG. 3.

Referring to FIG. 6, lower portion 54 of head 40 defines maximum lateral width 58, while upper portion 56 defines lateral width 60. As illustrated in this embodiment, maximum lateral width 58 is greater than lateral width 60. Head 40 also defines head recess 62. As illustrated in this embodiment, head recess 62 includes the difference between maximum lateral width 58 and lateral width 60. Pedestal 38 also defines a maximum lateral width 64. In one embodiment, pedestal 38 defines maximum lateral width 64 as a maximum lateral distance between lateral sides 46 of pedestal 38. As illustrated in this embodiment, maximum lateral width 58 is greater than maximum lateral width 64 of pedestal 38. In another embodiment, maximum lateral width 58 is less than maximum lateral width 64. As illustrated in FIG. 6, lateral width 60 of upper portion 56 of head 40 is also greater than maximum lateral width 64 pf pedestal 38. In this embodiment, diameter 31 (FIG. 4) is equal to or greater than maximum lateral width 58, 60, or 64 of steering console 32.

Referring to FIG. 7, a view from an operator positioned within interior region 24 is shown. Chassis 12, as well as mainframe 11, are shown. Mainframe 11 is shown defining maximum lateral width 68. Also shown in FIG. 7, steering wheel assembly 30 is located within interior region 24 and also located between operator seat assembly 50 and front side 20 of operator cab 13. More specifically, chamfer 48 is located between joysticks 52 and front side 20 of operator cab 13. Space 49 is shown to decrease viewable profile 70 (FIG. 8) of pedestal 38 and therefore increase the visibility past steering wheel assembly 30.

As shown in FIG. 8, maximum lateral width 68 of mainframe 11 is shown as equal to or greater than any maximum lateral widths 58, 60, or 64 (FIG. 6) of steering console 32. Viewable profile 70 without chamfer 48 of steering console 32 along vertical or substantially vertical line 51 (FIG. 5) is shown. As previously described, chamfer 48 (FIG. 5) and space 49 (FIG. 5) decrease the viewable profile of pedestal 38. For example, viewable profile 71 with chamfer 48 is less than viewable profile 70 without chamfer 48. Furthermore, chamfer 48 and space 49 provide an increased view of toe 17 or heel 19 of grader blade 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A motor grader including:

a chassis;

a plurality of traction devices positioned to support the chassis and including at least one front traction device and at least one rear traction device;

a grader blade supported by the chassis and positioned between the at least one front traction device and the at least one rear traction device;

an operator cab supported by the chassis, the operator cab including a plurality of sides defining an interior region, the plurality of sides including a front side and at least two lateral sides, the front side including at least one window;

an operator seat assembly supported by the chassis and configured to support an operator; and a console assembly supported by the chassis between the operator seat assembly and the front side of the operator cab, the console assembly including a console and a control supported on the console, the console including a base supported by the chassis and a pedestal supported by the base, the pedestal including a rear end, a forward end, and lateral sides including at least one substantially vertical chamfer extending rearward and inward to decrease the viewable profile of the console as seen by the operator in the operator seat assembly.

2. The motor grader of claim 1, wherein the at least one substantially vertical chamfer is adjacent to the rear end of the pedestal.

3. The motor grader of claim 1, wherein the chassis includes a mainframe extending between the at least one front traction device and the operator cab, the maximum lateral width between the lateral sides of the pedestal is less than or substantially equal to a maximum lateral width of the mainframe.

4. The motor grader of claim 1, wherein the control is a steering wheel.

5. The motor grader of claim 1, wherein the console is configured to tilt to any position between a first and a second position relative to the base.

6. The motor grader of claim 1, wherein the console encloses all console controls, plumbing, and wire harnesses.

7. The motor grader of claim 1, wherein the at least one substantially vertical chamfer is flat.

8. The motor grader of claim 1, wherein the at least one substantially vertical chamfer and the rear end of the pedestal cooperate to define an angle greater than approximately 100 degrees.

9. The motor grader of claim 8, wherein the angle is approximately 135 degrees.

10. The motor grader of claim 1, wherein the operator seat assembly includes a plurality of joysticks, each of the plurality of joysticks being configured to control at least one function of the motor grader, and the at least one substantially vertical chamfer is located between the plurality of joysticks and the front side of the operator cab.

11. The motor grader of claim 1, wherein the console assembly further includes a head supported by the pedestal and a lateral width of the head is greater than the maximum lateral width between the lateral sides of the pedestal.

12. The motor grader of claim 1, wherein the front side of the operator cab is defined between two vertical supports, the console located between the two vertical supports, wherein the at least one substantially vertical chamfer increases the operator's view of the grader blade between the console and an adjacent one of the vertical supports.

13. The motor grader of claim 1, wherein the at least one window is a forward-most window of the motor grader, and wherein the at least one substantially vertical chamfer increases the operator's view of the grader blade through the at least one window.

14. A motor grader including:

a chassis including a mainframe;

a plurality of traction devices positioned to support the chassis and including at least one front traction device and at least one rear traction device, the mainframe extending between the at least one front traction device and the operator cab and having a maximum lateral width measured at a location between the at least one front traction device and the operator cab;

a grader blade supported by the mainframe and positioned between the at least one front traction device and the at least one rear traction device;

an operator cab supported by the chassis, the operator cab including a plurality of sides defining an interior region, the plurality of sides including a front side and at least two lateral sides, the front side including at least one window; and a steering wheel assembly supported by the chassis, the steering wheel assembly including a steering console and a steering wheel rotatably supported on the steering console, the steering console including a rear end, a front end, and at least two lateral sides, a maximum lateral width between the at least two lateral sides of the console being less than the maximum lateral width of the mainframe.

15. The motor grader of claim 14, wherein at least one of the lateral sides of the console includes a substantially vertically extending chamfered region.

16. The motor grader of claim 15, wherein the substantially vertically extending chamfered region is configured to permit an operator positioned in the operator cab to view a portion of the grader blade through a space immediately adjacent to the substantially vertically extending chamfered region.

17. The motor grader of claim 15, wherein the substantially vertically extending chamfered region is configured to permit an operator positioned in the operator cab to view a toe or a heel of the grader blade.

18. The motor grader of claim 14, wherein a lateral width of the rear end of the console is less than approximately one-fourth of the maximum lateral width between the at least two lateral sides of the console.

19. The motor grader of claim 14, wherein the mainframe extends between the at least one front traction device and the front end of the steering console.

20. The motor grader of claim 14, wherein the maximum lateral width of the mainframe is measured at a location rearward of a rearward-most portion of the at least one front traction device.

21. The motor grader of claim 14, wherein the maximum lateral width of the mainframe is measured at a location rearward of the grader blade.

22. A motor grader including:

a chassis;

a plurality of traction devices positioned to support the chassis and including at least one front traction device and at least one rear traction device;

a grader blade supported by the chassis and positioned between the at least one front traction device and the at least one rear traction device;

an operator cab supported by the chassis, the operator cab including a plurality of sides defining an interior region, the plurality of sides including a front side and at least two lateral sides, the front side including at least one window; and a steering wheel assembly supported by the chassis, the steering wheel assembly including a steering console and a steering wheel rotatably supported on the steering console, the steering console including a rear end, a front side, and at least two lateral sides, the rear end of the steering console defining a maximum lateral width less than a maximum lateral width between at least two lateral sides of the steering console.

23. The motor grader of claim 22, wherein the steering console is devoid of a joystick.

24. The motor grader of claim 22, wherein the steering console includes a base, a pedestal supported by the base, and a head supported by the pedestal, the head includes a lower portion and an upper portion, the lower portion defines a maximum lateral width greater than a maximum lateral width of the upper portion.

25. The motor grader of claim 24, wherein the maximum lateral width of the upper portion is positioned to increase visibility of an operator positioned in the operator cab.

26. A motor grader including a chassis;

a plurality of traction devices positioned to support the chassis and including at least one front traction device and at least one rear traction device;

a grader blade supported by the chassis and positioned between the at least one front traction device and the at least one rear traction device; and a steering wheel assembly supported by the chassis, the steering wheel assembly including a steering console and a steering wheel rotatably supported on the steering console, the steering console having a maximum lateral width, the steering wheel having a maximum diameter, the maximum diameter of the steering wheel being equal to or less than the maximum lateral width of the steering console.

27. The motor grader of claim 26, wherein the maximum diameter of the steering wheel is less than approximately twelve inches.

28. The motor grader of claim 26, wherein the maximum diameter of the steering wheel is approximately ten inches.

29. The motor grader of claim 26, wherein the maximum lateral width of the steering console is less than or equal to approximately ten inches.

* * * * *